United States Patent [19]

Panzarella

[11] 4,062,341

[45] Dec. 13, 1977

[54] PATIO WOK STOVE

[76] Inventor: John M. Panzarella, 91 E. Jerge Drive, Elma, N.Y. 14059

[21] Appl. No.: 717,899

[22] Filed: Aug. 26, 1976

[51] Int. Cl.[2] ..... A47J 37/00; F24C 3/00

[52] U.S. Cl. ..... 126/41 R; 126/25 R

[58] Field of Search ..... 126/41, 25, 9, 275

[56] References Cited

U.S. PATENT DOCUMENTS

| | | | |
|---|---|---|---|
| 2,154,491 | 4/1939 | Chambers | 126/41 R |
| 3,789,822 | 2/1974 | Schantz | 126/41 R |
| 3,868,943 | 3/1975 | Hottenroth et al. | 126/25 R |
| 3,964,463 | 6/1976 | Dailey | 126/41 R |

*Primary Examiner*—Edward G. Favors

*Attorney, Agent, or Firm*—Howard Alan Taishoff

[57] ABSTRACT

A portable, gas fired Wok stove adapted particularly for outdoor cooking includes a vertically mounted outer cylinder. A heating chamber is suspended within the interior of the outer cylinder. One end of the heating chamber is open. A burner is carried in the other end of the heating chamber in substantial alignment with the heating chamber open end. A fuel system is carried in the interior of the outer cylinder nestled underneath the heating chamber. The Wok is supported in confronting alignment with the heating chamber open end such that the flow of high temperature gas exiting therethrough impinges on the Wok bottom evenly heating same. The outer cylinder and internally carried heating chamber coact to make the stove relatively insensitive to wind.

18 Claims, 2 Drawing Figures

PATIO WOK STOVE

Figure 1:
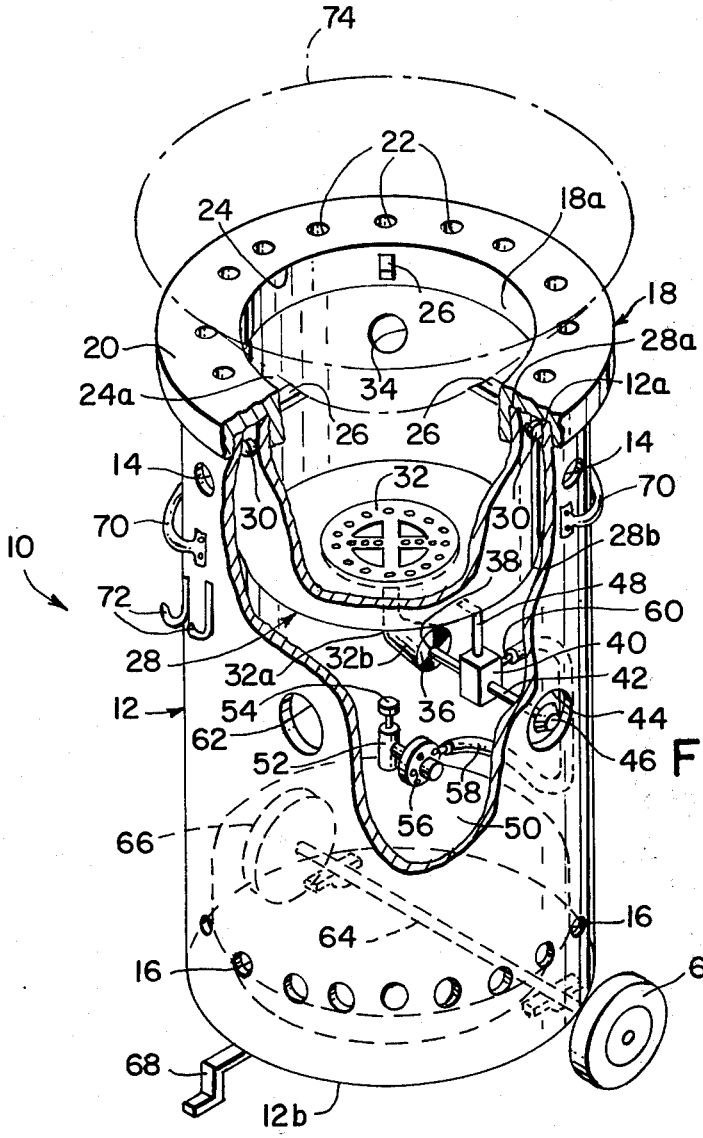

This invention relates to a portable cooking unit and, more particularly, the present invention relates to a portable Wok stove.

There are several portable cooking devices or portable barbecue assemblies available. These devices, while adequate for conventional barbecuing, leave room for improvement when used as stoves or as heat sources for the preparation of oriental dishes. Many of these oriental dishes are prepared in a large, essentially semispherical cooking pan. This pan is referred to as a Wok. Because Woks are relatively large when compared to conventional cooking pans, Wok cooking requires a relatively large heat input. For best results it is preferred that the Wok bottom experience as even heating. Moreover, in an outdoor environment wind gusts are apt to "push" or displace an exposed flame front to such a degree as to make cooking difficult. Thus, with conventional barbecue apparatus the heat input may be too low or the amount of wind shielding insufficient, or both. Then, too, some of the conventional apparatus require covers or tops for efficient operation. A cover requirement for a Wok stove would tend to make the apparatus unduly large. And further, the cover would make the apparatus cumbersome to use owing to the fact that that which is cooked in the Wok usually requires constant attention.

In general, the present invention comprises a portable, gas fired Wok stove wherein the Wok bottom is spaced from the flame front and is subjected to an even flow of high temperature gas. An outer closure or cylinder is vertically oriented with the upper end of the cylinder open. An annular collar formed with a central opening or aperture mounts detachably on the open end of the cylinder. A heating chamber, generally of cylindrical shape, has one open. The open end of the heating chamber is sized to fit about or generally cover the collar aperture. The open end of the heating chamber is positioned against the collar aperture and is attached thereto. The heating chamber depends from the annular collar in axial alignment with the collar aperture. The other end of the heating chamber extends into the interior of the outer cylinder. A burner or gas manifold is carried in this other end of the heating chamber such that the burner head is spaced from the collar aperture and is in confronting alignment therewith. Means supports the Wok in confronting alignment with the collar aperture such that the Wok bottom is placed slightly therein and spaced therefrom. A fuel system is sized to fit or nestle in the interior of the outer cylinder underneath the heating chamber. The high temperature gas impinging on the Wok bottom evenly heats the same. The outer cylinder and internally mounted heating chamber coact to shield the flame from wind.

It is therefore an object of the present invention to provide a portable Wok stove having a large heat input wherein a heating chamber is suspended within an outer closure making the flame relatively insensitive to wind.

It is another object of the present invention to provide a portable gas fired Wok stove that is generally of cylindrical shape wherein many of the elements thereof are substantially "in-line" with space being provided for carrying a source of fuel.

It is a further object of the present invention to provide a portable Wok stove adapted particularly for outdoor cooking wherein the Wok bottom is spaced from the flame front with the stove of simplified construction allowing same to be dismantled easily for cleaning or repair.

It is a still further object of the present invention to provide a self-contained gas fired Wok stove which is moved easily, allowing cooking to take place outdoors or on a patio, and which has a modern, attractive appearance.

Other objects and features of the present invention will become apparent from the following detailed description considered in connection with the accompanying drawings. It is to be understood, however, that the drawings are designed for purposes of illustration only and not as a definition of the limits of the invention for which reference should be made to the appended claims.

Figure 2:
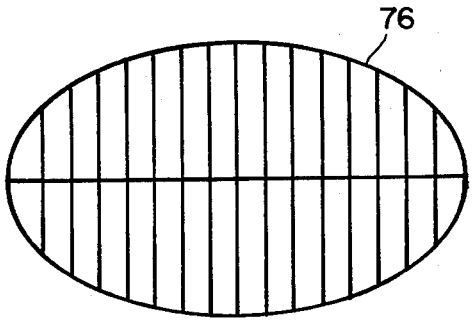

In the drawings, wherein the same reference numeral denotes the same element throughout the several views:

FIG. 1 is a perspective view of the portable Wok stove with parts broken away; and FIG. 2 is a perspective view of a grill for use with the stove of FIG. 1, the grill is used when heating a conventional pan or the like, the pan not shown.

More particularly now and referring to the drawings, FIG. 1 shows the portable Wok stove of the present invention with same being indicated generally by reference numeral 10. Stove 10 comprises a relatively large outer cylinder or cylindrically shaped closure 12. Upper cylinder end **12*a* is open. Lower cylinder end 12*b* is closed. A plurality or array of ventilation holes 14 and 16 are formed in cylinder 12 and perimetrically spaced adjacent their respective ends 12*a* and 12*b* as shown. An annular ring or collar 18 is sized and flanged to detachably mount or seat on the open end of the cylinder, namely end 12*a*. Collar 18 is formed with an outboard planar shelf 20 through which is disposed an array of ventilation ports 22. Collar shelf 20 is formed with a relatively large central aperture or opening 24 defined by an annular perimetric rim or lip 18*a*. A means for supporting the Wok in confronting alignment with aperture 24 and slightly therein includes a plurality of support fingers 26. Each finger 26 extends a short distance into collar aperture 24. During operation of the stove as will be described below, perimetric portions of the Wok bottom rest on fingers 26 thereby to define an annular or circumferential space 24*a* between the Wok and aperture-defing lip 18*a***.

A cylindrical heating chamber 28 has one end, end **28*a*, open. Chamber end 28*a* is sized to fit the outside periphery of lip 18*a* and it is demountably held thereon by means of a plurality of circumferentially spaced pinch screws 30. As shown, pinch screws 30 thread into and through the upper rim region of chamber 28 that defines chamber end 28*a*. End 28*a* is placed and locked on lip 18*a* in such manner as to position end 28*a* substantially in the plane of collar shelf 20 or slightly therebelow. The aforesaid positioning of chamber end 28*a* causes chamber 28 to depend or extend from collar 18 into the interior of cylinder 12. The other end of chamber 28, that is, end 28*b*, is adapted to carry or to fixedly receive a gas manifold or burner 32 as shown. A plurality of ventilation holes or apertures 34 are formed in the cylindrical wall of chamber 28** and they are disposed in a spaced array about the circumference thereof.

Burner 32 is of conventional design and it includes an elbow **32*a* having one end threaded into burner 32. The other end of the elbow flares to form a fuel-air mixing chamber 32*b*. As in common with such mixing chambers, an adjustable shutter 36 covers the open end thereof. Shutter 36 manually pivots about a fuel input orifice 38 into which is threaded the output port of a fuel or gas control unit 40. A control shaft 42 extends from control unit 40. A hole 44 is formed in cylinder 12 with the hole aligned to provide access to shaft 42. A knob 46 is carried on the end of shaft 42. The shaft is sized so as to place knob 46 adjacent hole 44 and inboard of cylinder 12. Turning knob 46 controls the rate of fuel flow and hence the heat input to the stove during operation of the stove as will be described shortly. A bracket 48 may be supplied to provide additional support for both control 40 and elbow 32***a*. In such case, it would be preferable to tack-weld one end of bracket 48 to chamber end 28*b*. The other end of the bracket would then be attached to control 40.

A fuel system comprises a container or pressure vessel 50 in which is stored a liquefied petroleum gas or fuel under pressure. Conventionally, this fuel consists of propane or butane, or a mixture of the two. A coupling 52 is threaded into tank 50 and it is preferred that coupling 52 include a master off-on valve 54. The output of coupling 52 is connected to a suitable pressure regulator 56. A flexible hole 58, carrying appropriate end-fittings, has one end thereof connected to the output of regulator 56. The other end of hose 58 is coupled to an input port 60 of control 40. An aperture 62 is placed in the wall of outer cylinder 12 to provide access to master valve 54 and to facilitate ventilation of the interior of cylinder 12. It will be observed that vessel 50 rests on the cylinder bottom of floor 12*b*. Vessel 50 is sized to nestle within the interior of cylinder 12 at a position underneath heating chamber 28.

A shaft or axle 64 is attached to the outboard and bottom surface of cylinder floor 12*b*. A wheel 66 is carried on each respective end of shaft 64 that extends from the cylinder floor as shown. A leg 68 is attached to cylinder 12. Leg 68 is sized so that the leg in conjunction with wheels 66, cause cylinder 12 to assume a stable, upright position. A pair of handles 70 are attached to the upper region of cylinder 12. And, a plurality of accessory hooks 72 are likewise attached to the upper region of the cylinder. Various cooking utensils or implements, the utensils not shown, can be carried on hooks 72.

In operation, valve 54 is opened. Knob 46 is appropriately rotated allowing fuel to flow into elbow mixing chamber 32*b*. The operator then ignites the gas or fuel flowing out of burner 32. It will be apparent that knob 46 provides primary control for the rate of fuel-flow into burner 32. Ventilation apertures 14 and 16 as well as apertures 22, 44 and 62 provide a continual supply of air to the interior of cylinder 12 and hence to burner 32 and chamber 28. Primary air used for combustion enters mixing chamber 32*b* through the ports of shutter 36 and also such air enters chamber 28 through the spaced construction of burner 32. Secondary air will be supplied to the interior of chamber 28 by means of chamber ventilation ports 34. A Wok 74, shown in phantom in FIG. 1, is placed on fingers 26. Fingers 26 orient the Wok botton slightly in collar aperture 24 yet spaced from aperture-defining lip 18*a*. With this orientation, the Wok is spaced from burner 32 although in confronting alignment therewith. The secondary air entering chamber 28 is heated to a high temperature by the flame therein to exit therefrom through opening 24, or more particularly, to exit through circumferential space 24*a*. The bottom of the Wok is then subjected to and heated by the high temperature gas impinging thereon and exiting chamber 28.

In addition to being used as a stove for heating a Wok, the inventive apparatus can be used as a stove or as heat source for heating conventional cooking implements such as flat pans and the like. To heat these more conventional implements, and now reference is made to FIG. 2, a grill 76 is supplied. Grill 76 is sized generally to cover collar opening 24 and rest on collar planar shelf 20. It will be apparent then that the pan is placed on grill 76 and positioned over opening 24. The pan is heated by the high temperature gas exiting through opening 24. Furthermore, and because a grill 76 riding merely on outboard collar shelf 20 may tend to "walk" relative to collar 18, a grill can be sized to fit in aperture 24. To facilitate the placing of a grill in aperture 24, the top or uppermost surface of fingers 26 can be recessed from the top or upper edge of perimetric lip 18*a*. With this construction and by seating the grill in aperture 24, the grill is constrained from moving relative to collar 18 by butting against aperture-defining lip 18*a*.

Stove 10 is moved easily by grasping either one of handles 70 and tilting outer cylinder 12 in a direction causing it to pivot on axle 64 and wheels 66. The stove can then be moved or towed on wheels 66. And, stove 10 is dismantled readily by lifting collar 18 from cylinder end 12*a*. Heating chamber 28 and attendant structure is detached from collar 18 by disengaging pinch screws 30 from reaction on the inboard periphery of lip 18*a*. In event that steel is used in the construction of outer cylinder 12 and heating chamber 28, it is preferred that the cylinder and chamber be coated with a temperature resistant paint, or plated.

While only a few embodiments of the present invention have been shown and described, it is to be understood that many changes and modifications can be made hereto without departing from the spirit and scope hereof.

What is claimed is:

1. A portable, gas fired stove adapted particularly for heating a Wok including a vertically mounted outer cylinder having the upper end open, an annular collar adapted to detachably mount on the open end of said outer cylinder, said collar being formed with a relatively large aperture, a heating chamber generally of cylindrical shape and positioned within the interior of said outer cylinder, said heating chamber having one end open, the open end of said heating chamber being sized substantially complementary to said collar aperture and substantially axially aligned therewith, said heating chamber being detachably carried by said collar in such manner as to depend into the interior of said outer cylinder with the open end of said heating chamber being substantially in the plane of said collar, burner means mounted in said heating chamber such that the last-mentioned means is spaced from said collar aperture and substantially axially aligned therewith, and means for supporting the Wok substantially in alignment with said collar aperture and spaced therefrom whereby the high temperature gas exiting therethrough evenly heats the Wok bottom.

2. The portable stove of claim 1, ventilation means on said outer cylinder and heating chamber.

3. The portable stove of claim 2, said ventilation means including a plurality of apertures formed in said outer cylinder and heating chamber to supply air to the respective interiors thereof.

4. The portable stove of claim 2, fuel control means coupled to said burner to control the flow of fuel to said burner.

5. The portable stove of claim 4, a source of pressurized fuel, said pressurized fuel source being coupled to said fuel control means and including a pressure vessel sized to fit in the interior of said outer cylinder to be carried therein underneath said heating chamber.

6. The portable stove of claim 5, said outer cylinder having its other end substantially closed, said pressure vessel adapted to rest on said substantially closed end and be nestled within the interior of said outer cylinder.

7. The portable stove of claim 6, said Wok support means including finger means carried by said collar.

8. A portable, gas fired stove adapted particularly for Wok cooking including in combination an outer shield generally of cylindrical shape and mounted vertically, the upper end of said shield being open, an annular collar formed with a central aperture and adaped to mount on the open end of said shield, said collar aperture being defined by an annular lip, a heating chamber generally cylindrical in shape and having one end open, said heating chamber adapted to detachably mount on said collar such that the peripheral region of said heating chamber defining said open end thereof is caused to react on said aperture-defining lip thereby to orient said heating chamber depending into the interior of said shield, burner means carried in the other end of said heating chamber thereby to space said burner means from said collar aperture, and means for supporting the Wok such that the Wok bottom confronts said collar aperture and is spaced therefrom whereby the flow of high temperature gas egressing said collar aperture impinges on the Wok bottom to evenly heat same.

9. The portable stove of claim 8, the mounting of said heating chamber on said collar being such so as to place said open end of said heating chamber substantially in the plane of said collar.

10. The portable stove of claim 9, said shield being formed with a plurality of ventilation holes, said heating chamber being formed with a plurality of ventilation holes, ventilation holes on said shield and heating chamber allowing air to flow into the respective interiors thereof.

11. The portable stove of claim 10, fuel control means serially coupled to said burner means to control the flow of fuel to the last-mentioned means.

12. The portable stove of claim 11, a source of fuel including pressurized vessel means adapted to be carried in said shield substantially underneath said heating chamber and coupled to said fuel control means.

13. The portable stove of claim 12, the other and lower end of said shield being substantially closed and adapted to support said pressure vessel means such that said pressure vessel means nestles within the interior of said shield.

14. The portable stove of claim 13, said Wok support means including a plurality of fingers carried on said annular collar.

15. The portable stove of claim 14, said fingers disposed substantially in the plane of said collar aperture, a grill sized complementary to said collar and adapted to be carried thereon so as generally to cover said collar aperture.

16. The portable stove of claim 15, said grill sized to fit into said collar aperture and rest on said fingers, said grill being carried in said collar aperture such that the circumferential periphery of said grill abuts said lip and is constrained thereby.

17. The portable stove of claim 14, means for supporting said shield in a stable vertical position with said shield support means being carried on the lower end of said shield.

18. The portable stove of claim 17, said shield support means including an axle, and a pair of wheels one of which is carried on a respective end of said axle.

* * * * *

UNITED STATES PATENT AND TRADEMARK OFFICE

CERTIFICATE OF CORRECTION

PATENT NO. : 4,062,341

DATED : December 13, 1977

INVENTOR(S) : John M. Panzarella

It is certified that error appears in the above-identified patent and that said Letters Patent are hereby corrected as shown below:

Col. 1, line 17, "as" should read --an--.
Col. 1, line 38, after "one" insert --end--.
Col. 2, line 47, "defing" should read --defining--.
Col. 3, line 31, "of" should read --or--.
Col. 6, line 4, after "holes," insert --said--.

Signed and Sealed this

Eighteenth Day of April 1978

[SEAL]

*Attest:*

RUTH C. MASON
*Attesting Officer*

LUTRELLE F. PARKER
*Acting Commissioner of Patents and Trademarks*